US006939128B2

(12) United States Patent
Suzuki et al.

(10) Patent No.: US 6,939,128 B2
(45) Date of Patent: Sep. 6, 2005

(54) IGNITION OPERATING MECHANISM FOR SLIDE TYPE LIGHTERS

(75) Inventors: Takayuki Suzuki, Shizuoka (JP); Tetsuya Mochizuki, Shizuoka (JP)

(73) Assignee: Tokai Corporation, Tokyo (JP)

( * ) Notice: Subject to any disclaimer, the term of this patent is extended or adjusted under 35 U.S.C. 154(b) by 0 days.

(21) Appl. No.: 10/297,966

(22) PCT Filed: Feb. 19, 2002

(86) PCT No.: PCT/JP02/01428

§ 371 (c)(1),
(2), (4) Date: Dec. 11, 2002

(87) PCT Pub. No.: WO02/066897

PCT Pub. Date: Aug. 29, 2002

(65) Prior Publication Data

US 2003/0157449 A1 Aug. 21, 2003

(30) Foreign Application Priority Data

Feb. 19, 2001 (JP) ..... 2001-041284
Feb. 18, 2002 (JP) ..... 2002-040333

(51) Int. Cl.[7] ..... F23Q 3/01

(52) U.S. Cl. ..... 431/130; 431/132; 431/255; 29/890.02

(58) Field of Search ..... 431/129, 130, 431/132, 162, 255; 29/890.02

(56) References Cited

U.S. PATENT DOCUMENTS 3,734,680 A * 5/1973 Maruyama ..... 431/132
5,310,336 A * 5/1994 Segawa ..... 431/131
5,531,591 A * 7/1996 Yamazaki ..... 431/153
5,833,448 A * 11/1998 Doucet et al. ..... 431/153
6,135,761 A * 10/2000 Chen ..... 431/132
6,186,772 B1 * 2/2001 Huang ..... 431/132
6,431,853 B1 * 8/2002 Sher ..... 431/153
6,443,727 B1 * 9/2002 Huang ..... 431/132
6,478,575 B2 * 11/2002 Sher ..... 431/153
6,612,833 B1 * 9/2003 Potzl ..... 431/215
6,682,341 B2 * 1/2004 Pan et al. ..... 431/153
6,733,277 B2 * 5/2004 Huang ..... 431/153
6,755,642 B2 * 6/2004 Zhang ..... 431/153

FOREIGN PATENT DOCUMENTS

DE 2408342 A1 * 9/1975 ..... F23Q/2/02
JP 60-175922 9/1985
JP 7-19470 1/1995

* cited by examiner

*Primary Examiner*—Cheryl Tyler
*Assistant Examiner*—James G. Barrow
(74) *Attorney, Agent, or Firm*—Dellett & Walters

(57) ABSTRACT

An ignition operation mechanism for slide type lighters that is capable of preventing accidental ignition or ignition due to erroneous use or the like while maintaining good operability, wherein pivots 22*a*, 22*a* for an operating cap 20 are made substantially circular in cross section and so sized as to form a vertically movable clearance as they are locked to a support section in the lighter main body, the pivots 22*a*, 22*a* for the operating cap 20 are normally urged to be positioned in the upper region of the interior of a support section by the spring force of a return spring for a piezoelectric mechanism 4, the operating cap 20 is slid until a lever member 21 strikes the lighter main body 1 and no longer moves in the slide direction, from which state (a), the operating cap is pressed downward, whereby the pivots 22*a*, 22*a* move downward (b) within the support section, whereupon pressing levers 23, 23 reach the operation stroke that overcomes the piezoelectric mechanism 4, producing a discharge voltage to enable ignition.

9 Claims, 10 Drawing Sheets

IGNITION OPERATING MECHANISM FOR SLIDE TYPE LIGHTERS

FIELD OF THE INVENTION

The present invention relates to an ignition operating mechanism for slide type lighters for spark igniting such lighters by sliding operation of an operation or actuation member.

BACKGROUND ART

Summary of the Invention

Among ignition operating mechanisms for piezoelectric ignition type gas lighters, there is a kind of lighters constructed to generate discharge voltage by pushing the piezoelectric mechanism as a result of slide operation of a pivotally supported operating cap, thereby causing spark discharge at the end of a nozzle to ignite the gas emitting from the nozzle. Gas lighters provided with such slide type ignition mechanism are generally known as slide type (or rocking type) lighters.

Incidentally, piezoelectric gas lighters require any type of safe guard to prevent accidental ignition by carelessly touching the ignition operating mechanism with a finger or the like or in case of children playing with such lighters. Conventional measures to prevent such accidental ignition by carelessness or misuse include increased initial operating load, step-wise increase of the operating load, and double-action of the ignition operation. However, such conventional measures are applicable only to those pushing the operation member in a single direction and thus not applicable directly to the slide type lighters.

In the conventional slide type lighters, design efforts of the operating load were focused on improving the operability. It was therefore difficult to prevent accidental ignition by careless touching the ignition operation member or children playing with the lighters.

It is therefore an object of the present invention to overcome such problems and provide the ignition operating mechanism for slide type lighters which maintains good operability and prevents accidental ignition by careless operation and misuse.

DISCLOSURE OF INVENTION

The ignition operating mechanism for slide type lighters according to the present invention is provided with an operation member pivotally supported at an upper curved portion at one edge of the lighter main body to rotate about a pivot substantially at the center of the curvature in such a manner to slide on and along the curved surface to push down a piezoelectric mechanism. It features in pushing operation of the operation member subsequent to the sliding operation to cause the pivot portion of the operation member moving downwardly inside a supporting portion of the lighter main body, thereby enabling to spark ignite by the piezoelectric mechanism.

More in detail, for example, the fulcrum portion acting as the pivot of the operation member is shaped and sized so that a predetermined clearance for the fulcrum portion to be engaged to pivot and move up and down inside the lighter main body. The fulcrum portion of the operation member is normally spring biased to the upper position inside the support section while moved downward upon pushing operation of the operation member subsequent to the slide operation, thereby enabling the fulcrum portion to spark ignite by the piezoelectric mechanism. In this case, the fulcrum portion of the operation member is spring biased upwardly inside the support section before pushing operation. And, in the ignition operation, only the slide operation maintains the fulcrum portion inside the support section, thereby disabling to gain the operation stroke sufficient to push down the piezoelectric mechanism. However, push-down operation of the operation portion subsequent to the slide operation enables the fulcrum portion to move downward for sufficiently pushing the piezoelectric mechanism, thereby enabling to generate discharge voltage for spark ignition.

Alternatively, a portion to be pushed of the piezoelectric mechanism in engagement with the pushing portion of the operation member is adapted so that the pushing portion disengages and falls down at the very end of the slide operation of the operation member. As a result, the pushing down of the operation member subsequent to the slide operation deforms the operation member to push down the portion to be pushed for spark ignition by the piezoelectric mechanism. In this case, simple slide operation of the operation member fails to give the operation stroke sufficient to completely push the piezoelectric mechanism because the pushing portion disengages from the portion to be pushed of the piezoelectric mechanism at the end of the slide operation. However, downward pushing of the operation member subsequent to the slide operation ensures that the operation member deforms and forces the portion to be pushed to be pushed down so that discharge voltage is generated for spark ignition.

Alternatively, the pushing portion of the operation member for engaging with the portion to be pushed of the piezoelectric mechanism is adapted to restrict the downward movement of the portion to be pushed at the end of the slide operation of the operation member not to reach the position for causing the spark ignition by the piezoelectric mechanism. However, pushing down of the pushing member subsequent to the slide operation of the operation member urges the operation member to deform for further push-down of the portion to be pushed to such extent sufficient to spark ignition by the piezoelectric mechanism. In this case, since the simple sliding of the operation member restricts the downward movement of the portion to be pushed at the end of slide operation, thereby not reaching the sufficient operation stroke of the piezoelectric mechanism. However, push-down of the operation member subsequent to the slide operation urges the operation member to deform for further pushing the portion to be pushed, thereby generating the discharge voltage for spark ignition.

Alternatively, the top end of the lighter main body is positioned so that the slide operation of the operation member at the end of the slide operation of the operation member does not cause the spark ignition by the piezoelectric mechanism. However, push-down operation of the operation member subsequent to the slide operation urges the operation member to be pushed down the portion to be pushed, thereby enabling spark ignition by the piezoelectric mechanism. In this case, since the slide operation of the operation member is restricted not to reach the spark ignition position by simple slide operation even at the end of the slide operation of the operation member, it does not accomplish the operation stroke of the piezoelectric mechanism. And additional downward pushing of the operation member subsequent to the slide operation urges the operation portion to deform for further pushing down the portion to be pushed leading to generation of the discharge voltage for the spark ignition.

Alternatively, a pivotal lever portion of the operation member restricts the movement in the slide direction not to reach the spark ignition by the piezoelectric mechanism because it strikes the upper edge of the lighter main body at the end of the slide operation of the operation member. However, push-down operation of the operation member subsequent to the slide operation urges the operation member to deform for further pushing the portion to be pushed, thereby leading to the spark ignition by the piezoelectric mechanism. In this case, since the simple slide operation of the operation member brings the pivotal lever portion to strike the upper edge of the lighter main body at the end of the slide operation and not to reach the spark ignition by the piezoelectric mechanism, it fails to accomplish the complete operation stroke of the piezoelectric mechanism. However, downward pushing of the operation member at the end of the slide operation urges the operation portion to deform for further pushing the portion to be pushed, thereby leading to generation of the discharge voltage for the spark ignition.

As understood from the above description, there requires a 2-step operation of the operation member, thereby ensuring to prevent careless ignition or ignition by misuse or the like.

And the 2-step ignition operation can be carried out in a course of a single movement of the operation member, thereby minimizing the burden to the operator's finger and maintaining good operability.

Additionally, the 2-step operation gives a time from emission of the fuel gas to the ignition as compared to the conventional spark ignition only by the slide operation, thereby providing sufficient time delay for mixing the fuel gas with air inside the cap and enhancing ignition reliability.

BEST MODE OF CARRYING OUT THE INVENTION (First Embodiment)

Figure 1:
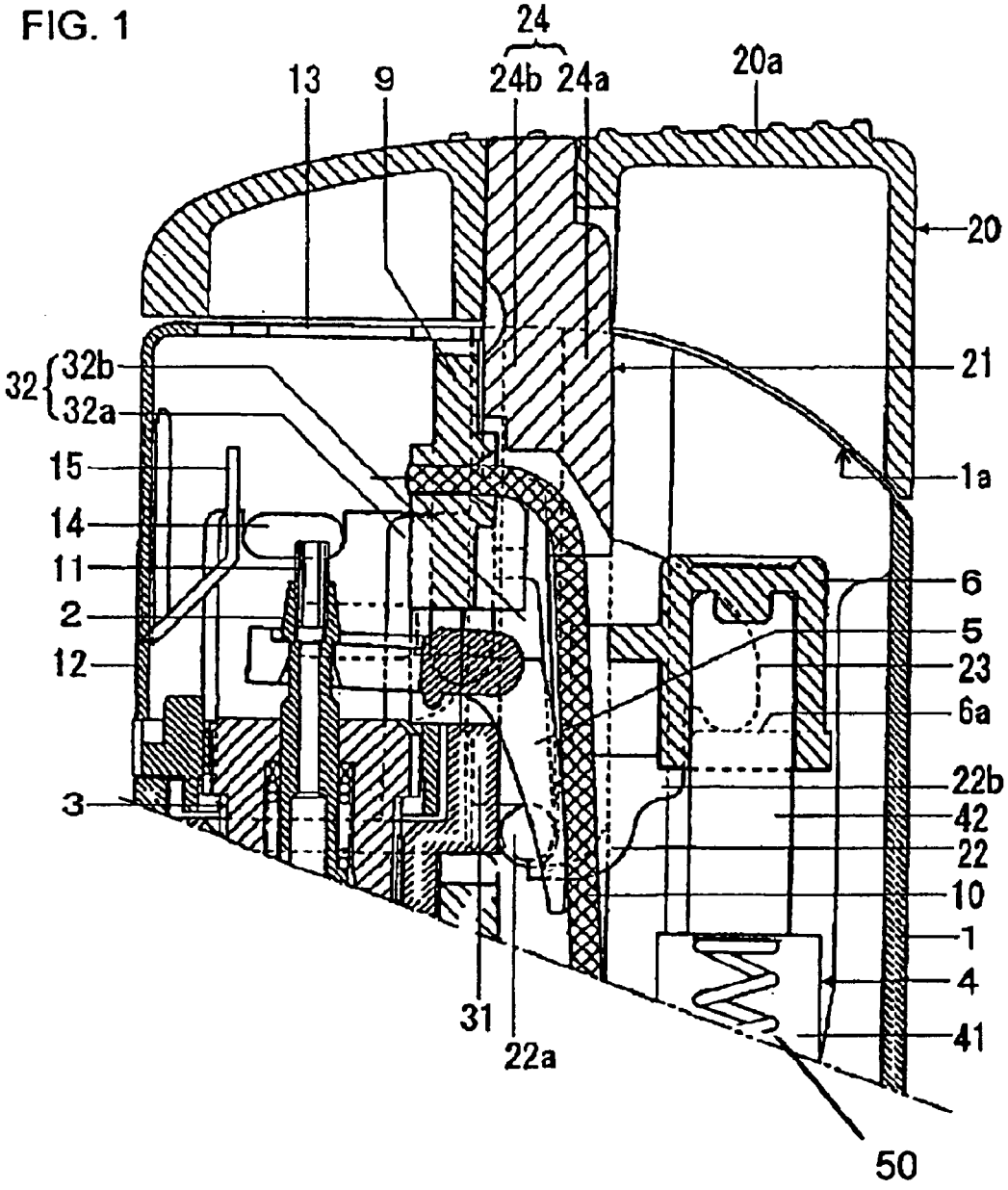
FIG. 1 is a longitudinal cross section view of the upper portion of the slide type lighter according to the first embodiment of the present invention.
Figure 2A:
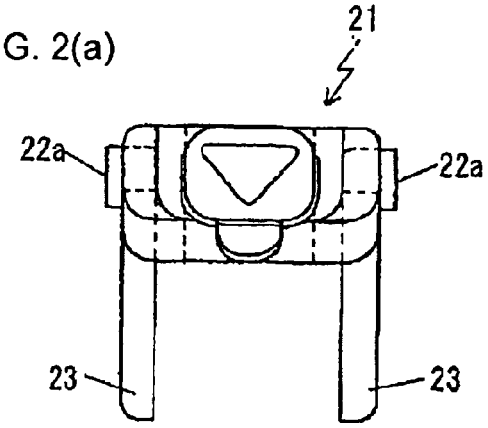
FIG. 2 shows a lever portion of the operation cap of the slide type lighter according to the first embodiment of the present invention, wherein (a) is a plan view, (b) is a front view and (c) is a longitudinal cross section view.
Figure 2B:
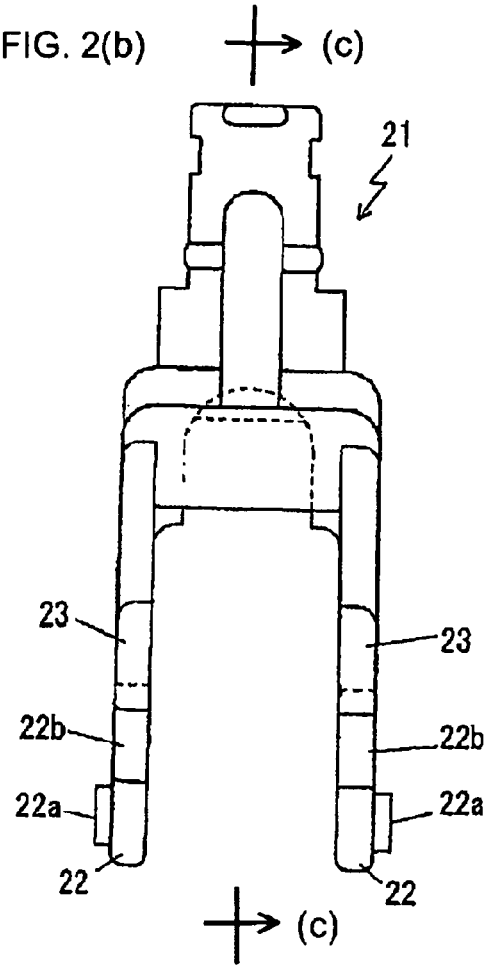
Figure 2C:
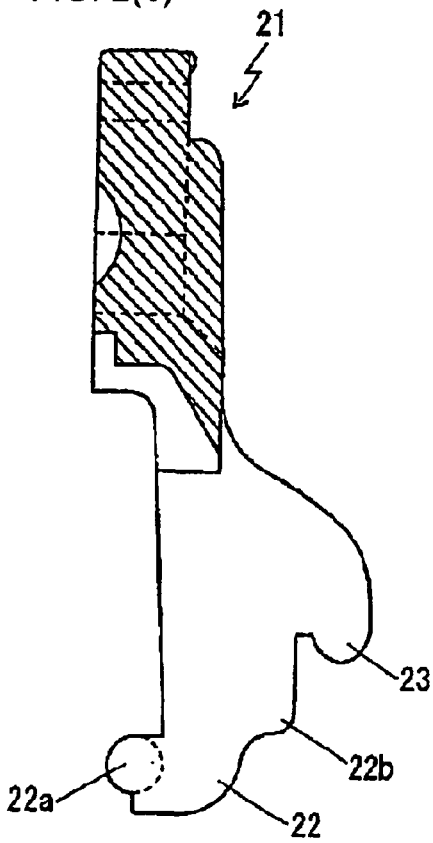
Figure 3:
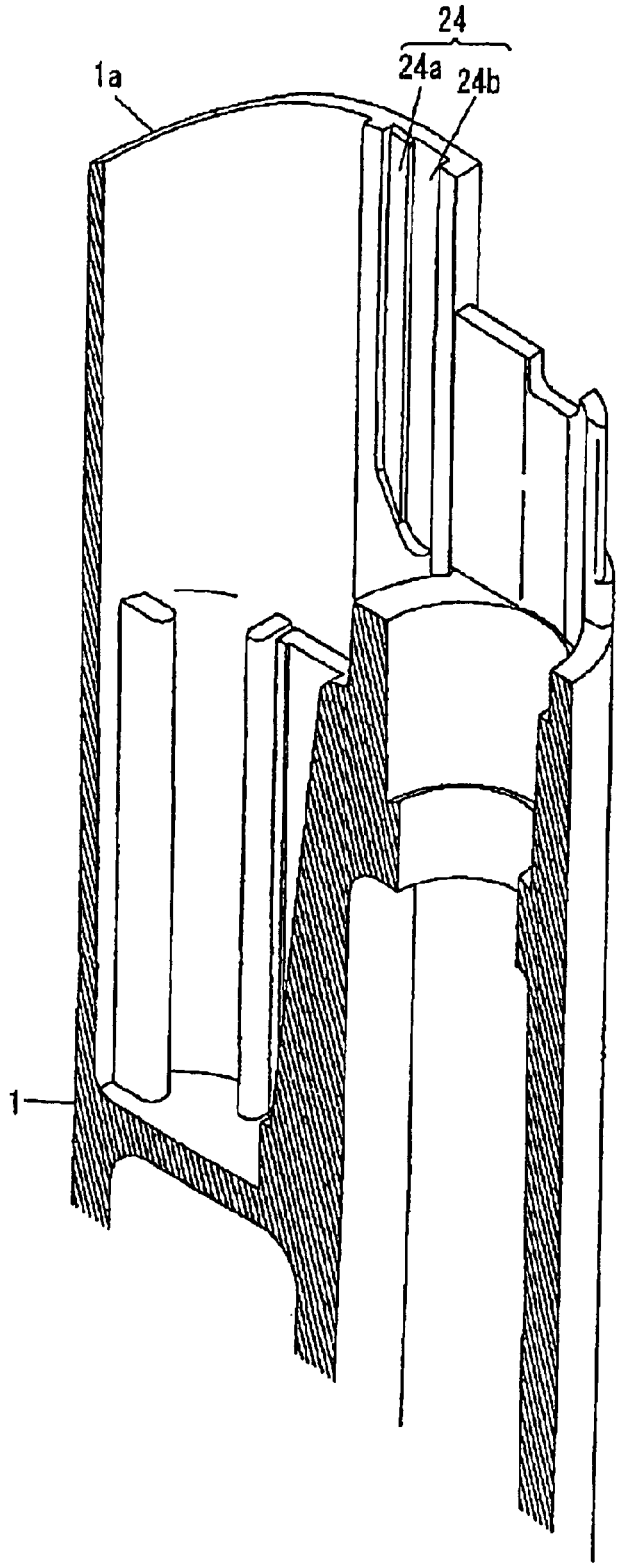
FIG. 3 is a perspective cross section view of the upper portion of the lighter main body of the slide type lighter according to the first embodiment of the present invention.
Figure 4A:
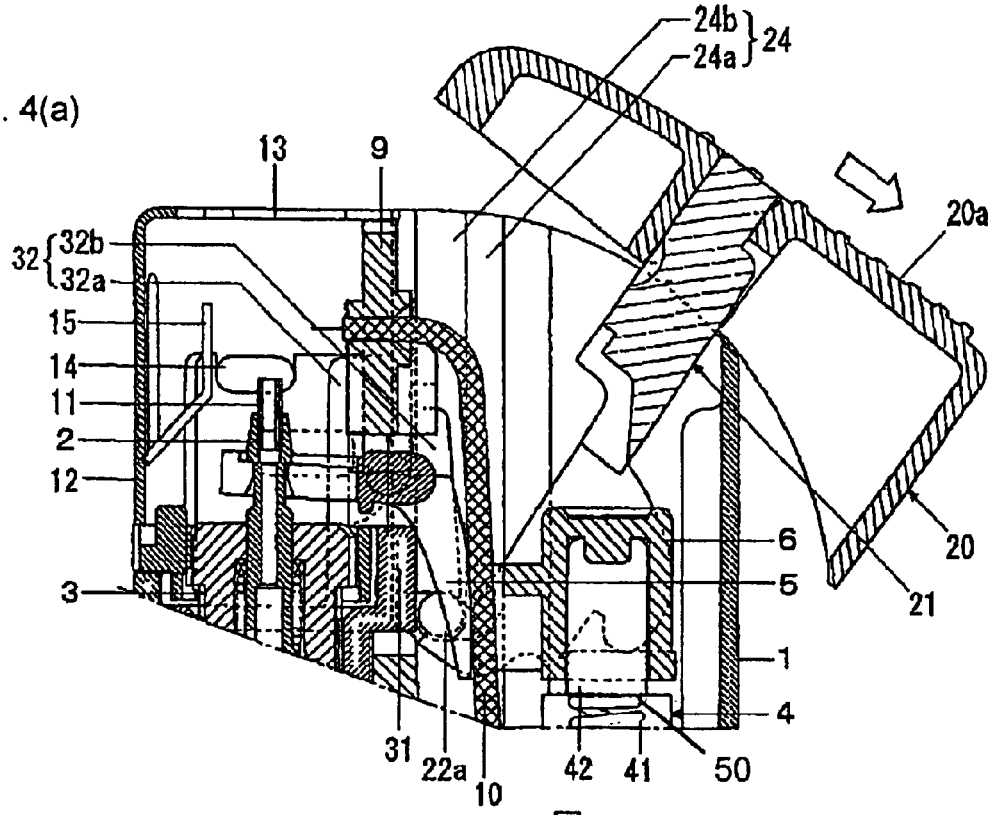
FIG. 4 shows a cross section view of the upper portion of the slide type lighter according to the first embodiment of the present invention, wherein (a) is in the middle of ignition operation and (b) is at the time of ignition.
Figure 4B:
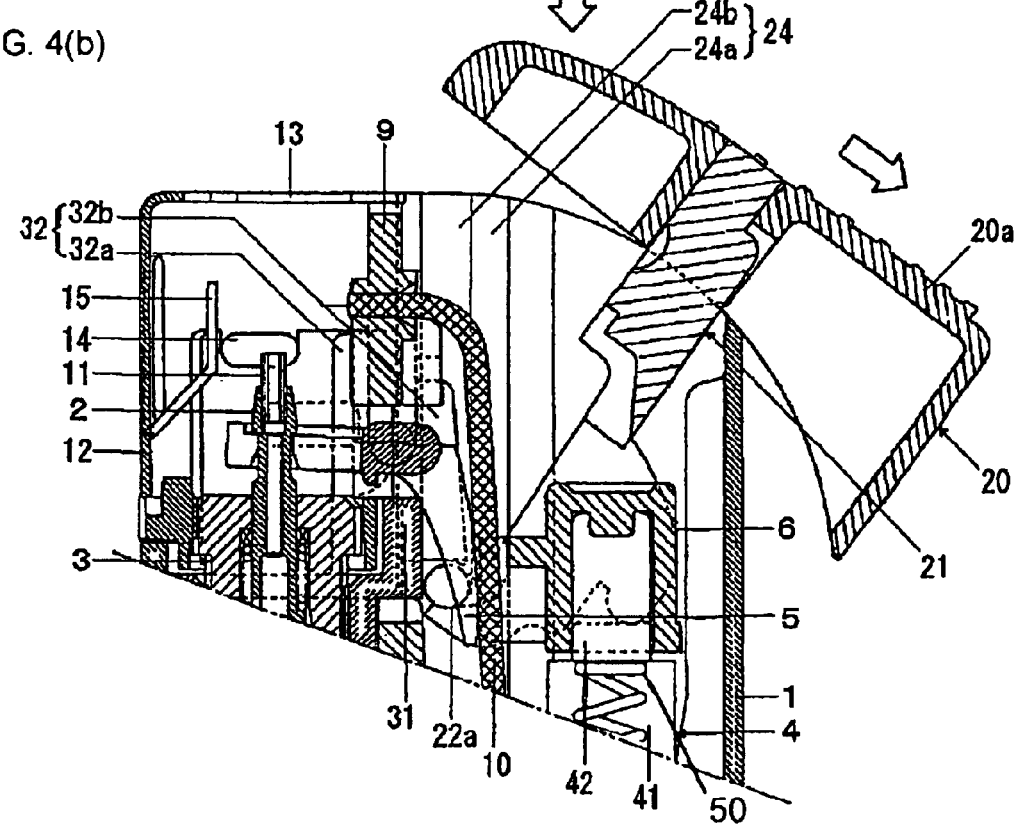

FIGS. 1–4 show a first embodiment of the present invention. FIG. 1 is a longitudinal cross section view of the upper portion of the slide type lighter according to the first embodiment. FIG. 2 shows a lever member of an operating cap of the slide type lighter, wherein (a) is a plan view, (b) is a front view and (c) is a longitudinal cross section view. FIG. 3 is a cross section perspective view of the upper portion of a lighter main body of the slide operation type lighter. FIG. 4 shows the upper portion of the slide type lighter, wherein (a) is a longitudinal cross section view in the middle of ignition operation and (b) is a longitudinal cross section view at the time of ignition.

As shown in FIG. 1, the lighter comprises a lighter main body 1 constituting a tank for filling fuel gas therein. Disposed at one end of and inside the lighter main body 1 is an emission unit 3 having a nozzle 2 for emitting fuel gas through a valve mechanism for opening and closing a gas passage. Disposed adjacent to the emission unit 3 at the other end portion inside the upper portion is a piezoelectric mechanism 4. Additionally, disposed at the center portion between the emission unit 3 and the piezoelectric mechanism 4 is a gas lever 5.

The gas lever 5 is generally L-shaped and has one end extending horizontally to engage a neck portion constituting the valve mechanism of the emission unit 3. The other end of the gas lever 5 extends downwardly towards the side surface of the piezoelectric mechanism 4 for slidably engaging a lever pusher 6 connected to an electrode terminal at the upper end of the piezoelectric mechanism 4. The center portion of the gas lever 5 is supported as a pivotal fulcrum by the lighter main body 1.

The piezoelectric mechanism 4 comprises an outer box 41 containing a piezoelectric element therein for generating the discharge voltage (or high voltage pulse) upon being impacted and an inner box 42 containing a hammer (not shown) therein for impacting the piezoelectric element (not shown). Disposed inside the outer box 41 is a spring (return spring) 50 for varying the distance between the piezoelectric element and the hammer for initially increasing the distance in the axial direction by extending a part of the inner box 42 upwardly. On the other hand, disposed within the inner box 42 is a spring (hammer spring) biased in such a manner to upwardly press the hammer against the piezoelectric element.

The piezoelectric mechanism 4 is disposed with the inner box 42 facing upwardly. A lever pusher 6 made from electrically conductive material is attached to the upper end of the inner box 42 and an electrical terminal at the upper end of the inner box 42 is connected to the lever pusher 6. On the other hand, another electrode terminal (not shown) is provided at the lower side surface of the outer box 41.

An isolation plate 9 is assembled at the center top portion of the lighter main body 1 for separating the ignition space surrounding the upper end of the nozzle 2 from the piezoelectric mechanism 4. A high voltage lead wire 10 is inserted into the space for accommodating the piezoelectric mechanism 4 with one end of the high voltage lead wire 10 connected to the lower electrode terminal of the piezoelectric mechanism 4 while the other end extending through the isolation plate 9 and being disposed at a predetermined distance from a nozzle tip 11 at the upper end of the nozzle 2, thereby forming a spark gap.

Additionally, installed at the upper portion of the lighter main body 1 is an inner cap 12 in such a manner to cover the ignition space surrounding the nozzle 2 and separated by the isolation plate 9. The inner cap 12 is adapted to generate upward oriented flame by spark igniting the mixture of air and the fuel gas emitted from the nozzle 2. A crater 13 is formed immediately above the nozzle 2. Air windows 14 are formed at the top and predetermined side locations. A bent tongue member 15 is formed inside the sidewall portion along the flow of the fuel gas emitting from the nozzle 2.

As an operation member of ignition operation for pushing the piezoelectric mechanism 4, a slide operation type operating cap (operation member) 20 is disposed at the upper portion of the lighter main body 1. The operating cap 20 is provided with a lever member 21 having a pair of parallel fulcrum levers 22, 22 at substantially center portion of the cap main body 20*a* covering the entire upper portion of the lighter main body 1.

As shown in FIGS. 2(*a*), (*b*) and (*c*), the lever member 21 is formed with a pair of outwardly protruding pivot portions 22*a*, 22*a* at the corresponding lower end portions of the fulcrum levers 22, 22. Extending in one direction (towards the operation side of the slide operation) from the root of the fulcrum levers 22, 22 are pressing, or pushing, levers 23, 23 for pushing the piezoelectric mechanism 4. In the assembled condition (see FIG. 1), protruding portions 22*b*, 22*b* are formed between the fulcrum levers 22, 22 and the pressing levers 23, 23 in such a manner to substantially filling the gap between the side portions of the lever pusher 6.

The cap main body 20*a* is formed in an arc shape centered of the pivot portions 22*a*, 22*a* at the lower ends of the fulcrum levers 22, 22 in the lower edge which is the operation side of the slide operation.

The lever pusher 6 is generally cap shape in the main body portion and is formed with a flange portion 6*a* at the periphery of the lower end.

The piezoelectric mechanism 4 is pre-assembled as a unit. The lever pusher 6 is secured onto the upper end of the inner box 42 at the upper position of the unit. They are assembled with the lighter main body 1 as an integral part and then the operation cap 20 having the lever member 21 is assembled at the top.

FIG. 3 shows one side of the lighter main body 1 formed with grooves 24 & 24 (not shown) in the upper inner surface at the locations corresponding to the pivot portions 22*a*, 22*a* at the lower end of the fulcrum levers 22, 22 of the lever member 21 formed with the operation cap 20 for properly guiding them and engaging them in position. These grooves 24, 24 comprise parallel guide portions 24*a* & 24*a* (not shown) and engaging portions 24*b* & 24*b* (not shown); the guide portions 24*a*, 24*a* guiding pivot portions 22*a*, 22*a* in the condition inwardly deforming the lower ends of the fulcrum levers 22, 22 of the lever member 21 in assembling the operating cap 20 while the engaging portions 24*b*, 24*b* engaging the fulcrum levers 22, 22 in releasing the deformation thereof at the predetermined supporting location. For this end, the engaging portions 24*b*, 24*b* are deeper than the guide portions 24*a*, 24*a*. The guide portions 24*a*, 24*a* and the engaging portions 24*b*, 24*b* are adjacent to each other with a step between them. The guide portions 24*a*, 24*a* are sloped just before the lower end thereof for guiding the fulcrum portions 22*a*, 22*a* towards the engaging portions 24*b*, 24*b*.

The operation cap 20 is inserted into the lighter main body 1 while inwardly deforming the fulcrum levers 22, 22 in aligning the pivot portions 22*a*, 22*a* with the guide portions 24*a*, 24*a* in the lighter main body 1, thereby securing the pivot portions at the predetermined supporting position.

An upper lid 31 is fitted and welded at the flange portion in the lighter main body 1 at the portion for accommodating the emission unit 3. The emission unit 3 is assembled with the upper lid 31. Provided above the upper lid 31 are forked posts 32, 32 at the location biased to one side and opposed at the left and right positions.

Each of the posts 32, 32 on the upper lid 31 comprises relatively higher post portion 32*a*, 32*a* at the inner side of the forked portion and relatively lower and wider (in cross section) post portions 32*b*, 32*b* at the outer side. The forked portion supports the pivotal fulcrum of the gas lever while the inner post portions 32*a*, 32*a* support the isolation plate 9. On the other hand, the outer side post portions 32*b*, 32*b* extending in the width direction fit into the engaging portions 24*b*, 24*b* in the grooves 24, 24 in the lighter main body 1. Fitted in the engaging portions 24*b*, 24*b* at the lower ends thereof are pivot portions 22*a*, 22*a* at the lower ends of the fulcrum levers 22 constituting the lever member 21 coupled to the operating cap 20, thereby providing a space of the predetermined clearance to allow up and down movement.

In the particular construction as described above, the fulcrum levers 22, 22 of the lever member 21 are deformed to fit the pivot portions 22*a*, 22*a* into the guide portions 24*a*, 24*a* of the grooves 24, 24 in the lighter main body 1. When the operating cap 20 is pushed down along the guide portions 24*a*, 24*a*, the pivot portions 22*a*, 22*a* are guided into the engaging portions 24*b*, 24*b* at the lower ends of the guide portions 24*a*, 24*a*, thereby permitting the fulcrum levers 22, 22 to expand outwardly to release the deformation. And the pivot portions 22*a*, 22*a* fitted into the engaging portions 24*b*, 24*b* hooking the bottom surface of the outer side post portions 32*b*, 32*b* of the upper lid 31, thereby restricting the upward movement and restricting the movement from the engaging portions 24*b*, 24*b* to the guide portions 24*a*, 24*a* in the grooves 24, 24 by the abutment of the projection portions 22*b*, 22*b* against the side of the lever pusher 6. Also, on the way of pushing the pivot portions 22*a*, 22*a* into and along the guide portions 24*a*, 24*a* of the grooves 24, 24 by deforming the fulcrum levers 22, 22, the projection portions 22*b*, 22*b* make contact with the side portions of the lever pusher 6 for pushing the piezoelectric mechanism 4. The piezoelectric mechanism 4 tilts to effect the spring action for pushing back the fulcrum levers 22, 22, thereby forcing the pivot portions 22*a*, 22*a* to be pushed into the support portion at the bottom ends of the engaging portions 24*b*, 24*b*.

As apparent from the above description, the operating cap 20 can be easily and reliably assembled by simple pushing in one direction. Moreover, even if shock by dropping or the like is applied, the projection portions 22*b*, 22*b* are clamped by abutting against the lever pusher 6. The spring action of the spring (return spring) of the piezoelectric mechanism 4 pushes back the lever member 21 to the support position, thereby preventing the lever member 21 or the like from jumping out.

The lighter main body 1 is formed with an arc shaped curved surface portion 1*a* along the lower edge of the operating cap 20 at one edge side of the upper portion or the operation side of the slide operation. The curved surface portion 1*a* is adapted to locate the fulcrum portions 22*a*, 22*a* of the operation cap 20 at substantially the center of the curvature. The slide operation of the operating cap 20 is in one direction (or clockwise in FIG. 1). The operating cap 20 rotates about the pivot portions 22*a*, 22*a* to slide along the curved surface of the curved surface portion 1*a*.

As described hereinabove, the pivot portions 22*a*, 22*a* of the operating cap 20 are fitted into and secured in the supporting position at the lower ends of the engaging portions 24*b*, 24*b*. The lower side and the upper lid 31 side are sectioned by the lower side and the side surface of the engaging portions 24*b*, 24*b*, respectively. The upper side is sectioned by the lower surface of the post portions 32*b*, 32*b* extending in the outside width direction of the upper lid 31. Additionally, the sides of the guide portions 24*a*, 24*a* are sectioned by the step portion between the engaging portions 24*b*, 24*b* and the guide portions 24*a*, 24*a*. And the outer side is engaged with the support portion at the side of the lighter main body 1 sectioned by the side portion of the lever pusher 6, thereby supporting the pivot portions 22*a*, 22*a* of the operating cap 20 in such a manner to rotate freely.

And the pivot portions 22*a*, 22*a* of the operating cap 20 have substantially circular in cross section and are sized to move up and down while engaged with the support portion.

The above mentioned clearance is developed by virtue of the spring force of the return spring of the piezoelectric mechanism 4 to normally (before operation and during the sliding operation) hold the pivot portions 22*a*, 22*a* of the operating cap 20 at the upper position within the support portion and to strike the lower surface of the post portions 32*b*, 32*b* of the upper lid 31. The clearance developed below the lower surface of the engaging portions 24*b*, 24*b* as shown in FIG. 1 is maintained so long as the operating cap 20 is slid until the lever member 21 strikes the lighter main body 1 to prevent further movement in the sliding direction as shown in FIG. 4(*a*). However, when the operating cap 20 is pushed down subsequent to the above condition, the pivot portions 22*a*, 22*a* moves downward within the support portion, thereby striking the bottom surface of the engaging portions 24*b*, 24*b* as shown in FIG. 4(*b*). Accordingly the lighter is designed so that the pushing lever 23, 23 can be pushed down to the complete operation stroke of the piezoelectric mechanism 4 to generate the discharge voltage for the spark ignition.

In this case, the operating cap 20 rotates in accordance with the slide operation to open up the area near the crater 13. The pushing levers 23, 23 at the lower portion of the operating cap 20 push the side portion of the lever pusher 6 that pushes down the piezoelectric mechanism 4. As a result of pushing the piezoelectric mechanism 4, the inner box 42 goes down to rotate the gas lever 5 which is slidably engaging with the lever pusher 6. The nozzle 2 is, then, pulled up to open the valve mechanism of the emission unit 3 to emit the fuel gas from the nozzle 2. However, in the ignition operation, even if the operating cap 20 is slid only to the extreme position, lever member 21 strikes the lighter main body 1 and the pivot portions 22*a*, 22*a* remain in abutment with the lower surface of the post portions 32*b*, 32*b* (see FIG. 4(*a*)), thereby making it impossible to gain the operation stroke for fully pushing the piezoelectric mechanism 4.

Downward pushing operation of the operating cap 20 subsequent to the slide operation, the pivot portions 22*a*, 22*a* can be moved down to gain the complete operation stroke of the piezoelectric mechanism for generating the discharge voltage. Then, the discharge voltage is generated between the upper end of the high voltage lead wire 100 and the nozzle tip 11, thereby spark igniting the fuel gas.

(Second Embodiment)

Figure 5:
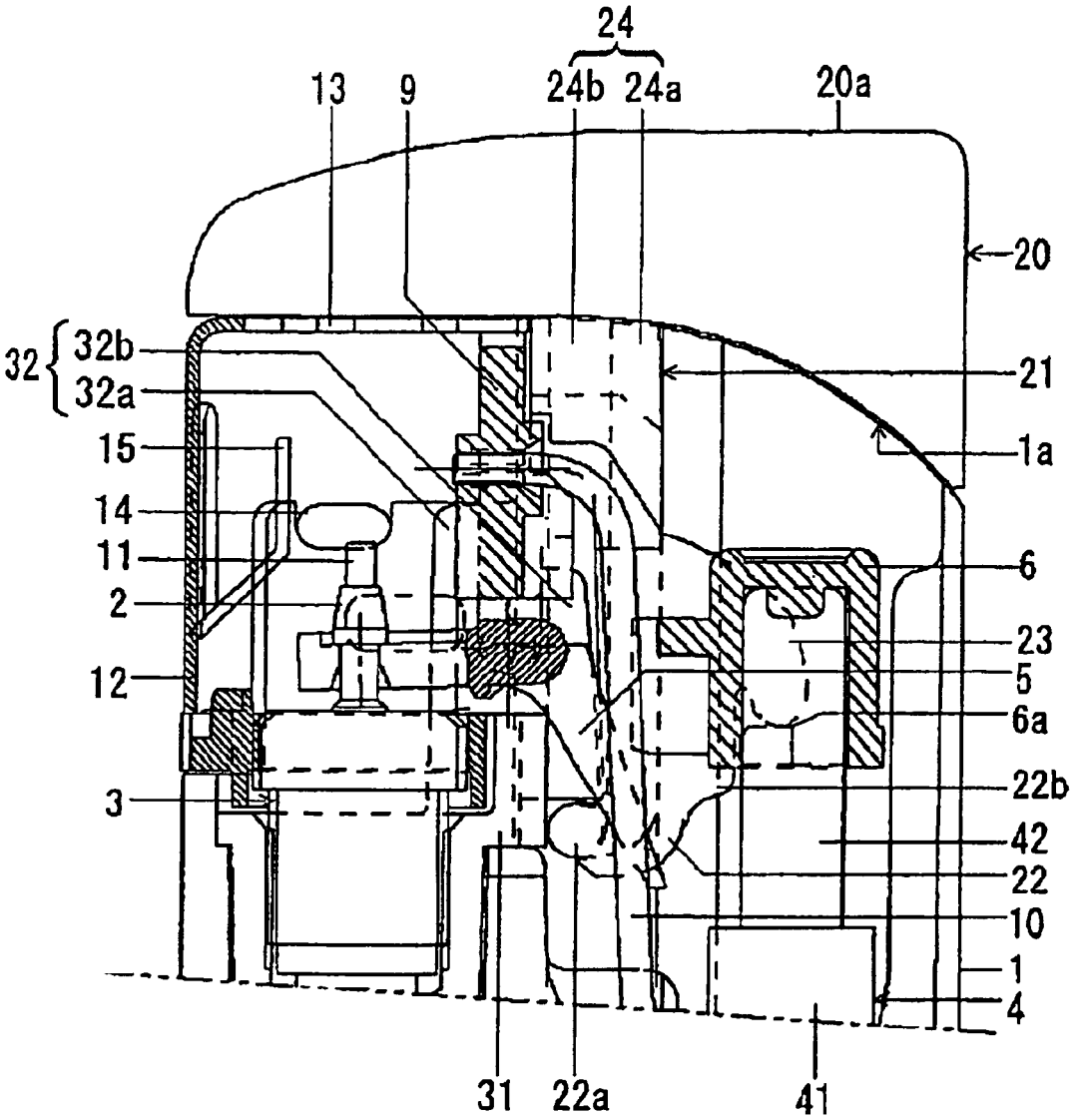
FIG. 5 is a longitudinal cross section view of the upper portion of the slide type lighter according to a second embodiment of the present invention.
Figure 6:
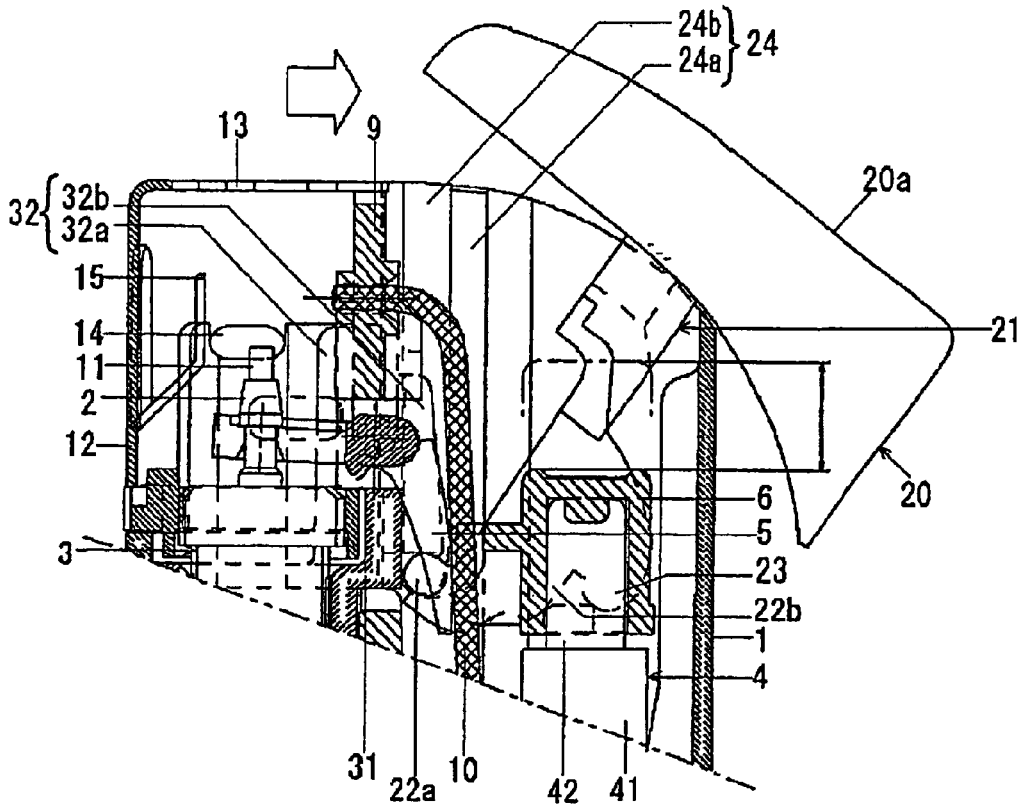
FIG. 6 shows a cross section view of the upper portion of the slide type lighter according to the second embodiment of the present invention, wherein (a) is in the middle of ignition operation and (b) is at the time of ignition.
Figure 6B:
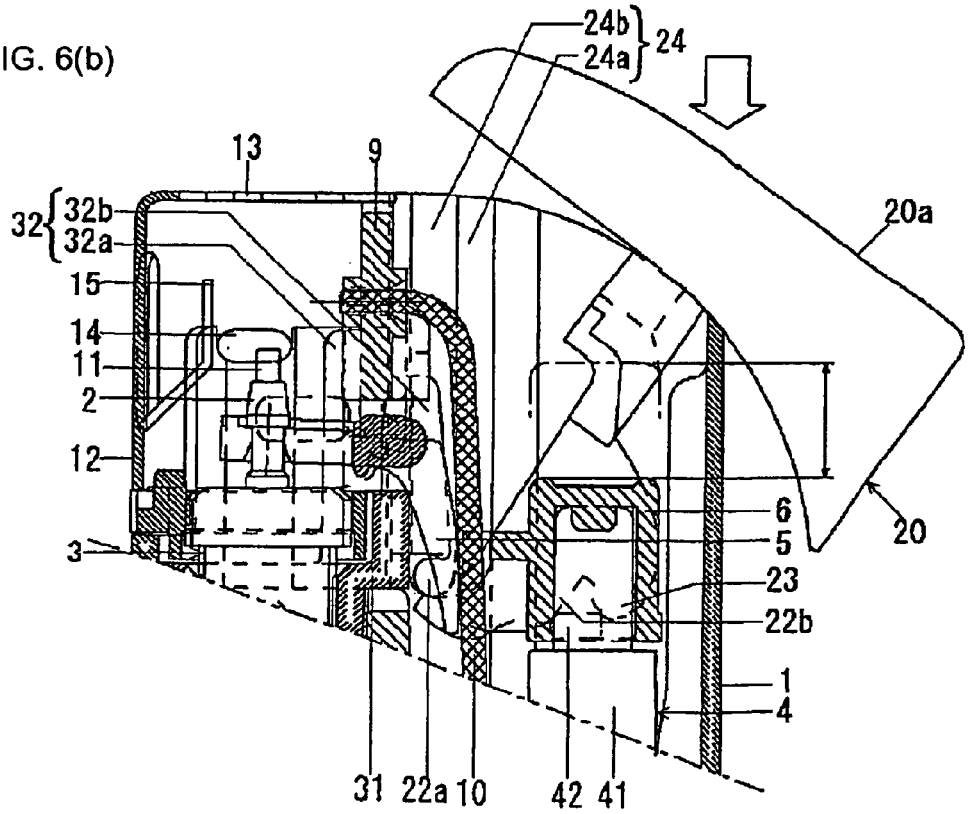

FIGS. 5 and 6 show a second embodiment of the present invention. FIG. 5 is a longitudinal cross section view of the upper portion of the slide type lighter according to the second embodiment of the present invention. FIG. 6 is a longitudinal cross section view of the upper portion of the slide type lighter, wherein (a) is in the middle of ignition operation while (b) is at the time of ignition.

The lighter of the second embodiment has basically the same construction and function as the lighter of the first embodiment. Accordingly, the portions common to those of the first embodiment have the same reference numerals in the drawings and the following descriptions are focused mostly on special portions to this embodiment.

In this embodiment, it is adapted that the post portions 32*b*, 32*b* of the upper lid 31 are fitted into the engaging portions 24*b*, 24*b* of the grooves 24, 24 in the lighter main body 1. The support portion of the operating cap 20 is designed to create essentially no clearance in vertical direction when the pivot portions 22*a*, 22*a* of the operating cap 20 are fitted.

A flange portion (a portion to be pushed) 6*a* of the lever pusher 6 that is pushed by the pushing levers (the pushing portion) 23, 23 of the operating cap (the operation member) 20 contacts the pushing levers 23, 23 before ignition operation as shown in FIG. 5(*a*). And the pushing levers 23, 23 move on and keep pushing the upper surface of the flange portion 6*a* until the middle of the slide operation of the operating cap 20. However, since the slide side is cut away, the pushing levers 23, 23 fall out of the upper surface of the flange portion 6*a* at the final stage of the slide operation so that the operation stroke does not lead to the spark ignition by the piezoelectric mechanism 4 as shown in FIG. 6(*a*).

In this case, only the slide operation of the operating cap 20 does not provide the operation stroke necessary for complete pushing of the piezoelectric mechanism 4. However, downward pushing operation of the operating cap 20 subsequent to the slide operation forces the operating cap 20 made from a plastic material to deform and push down the lever pusher 6 by the projecting portions 22*b*, 22*b* of the pressing levers 23, 23, thereby actuating the piezoelectric mechanism 4 as shown in FIG. 6(*b*).

(Third Embodiment)

Figure 7:
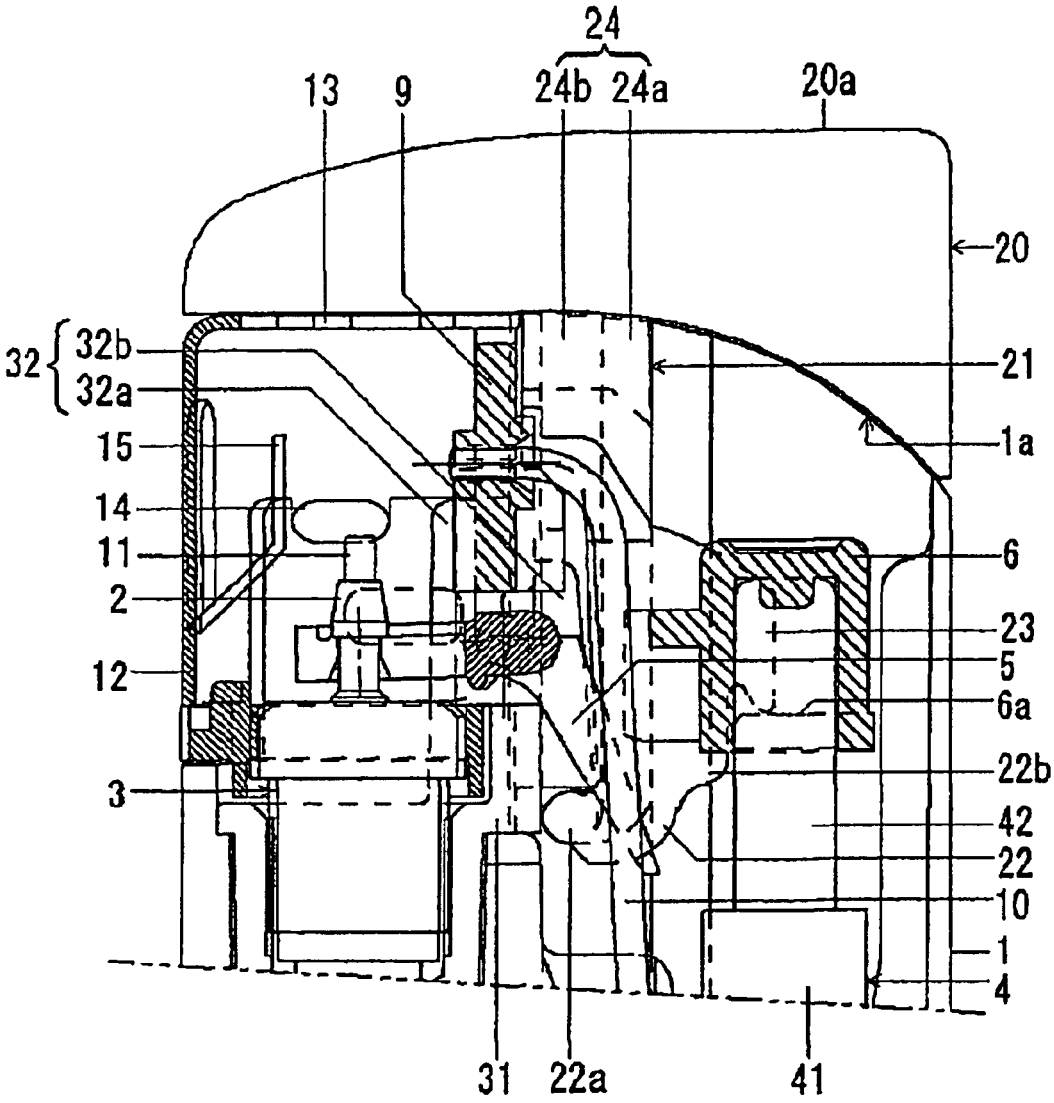
FIG. 7 is a longitudinal cross section view of the upper portion of the slide type lighter according to a third embodiment of the present invention.
Figure 8A:
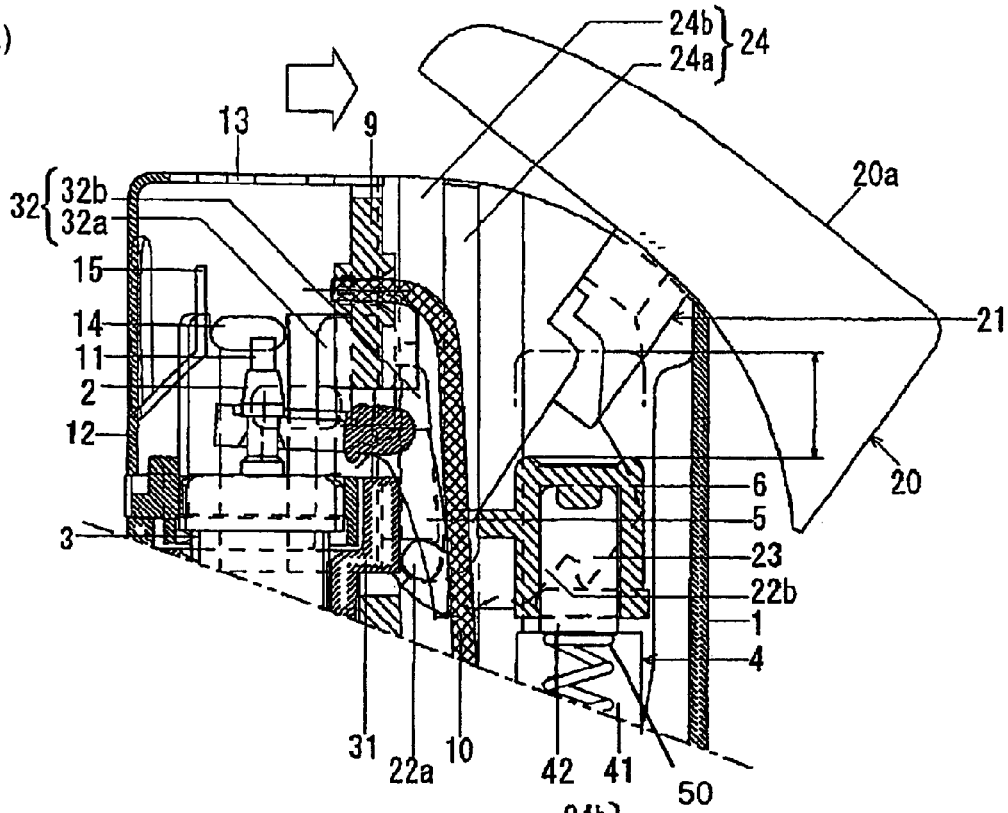
FIG. 8 shows a longitudinal cross section view of the upper portion of the slide type lighter according to the third embodiment of the present invention, wherein (a) is in the middle of ignition operation and (b) is at the time of ignition.
Figure 8B:
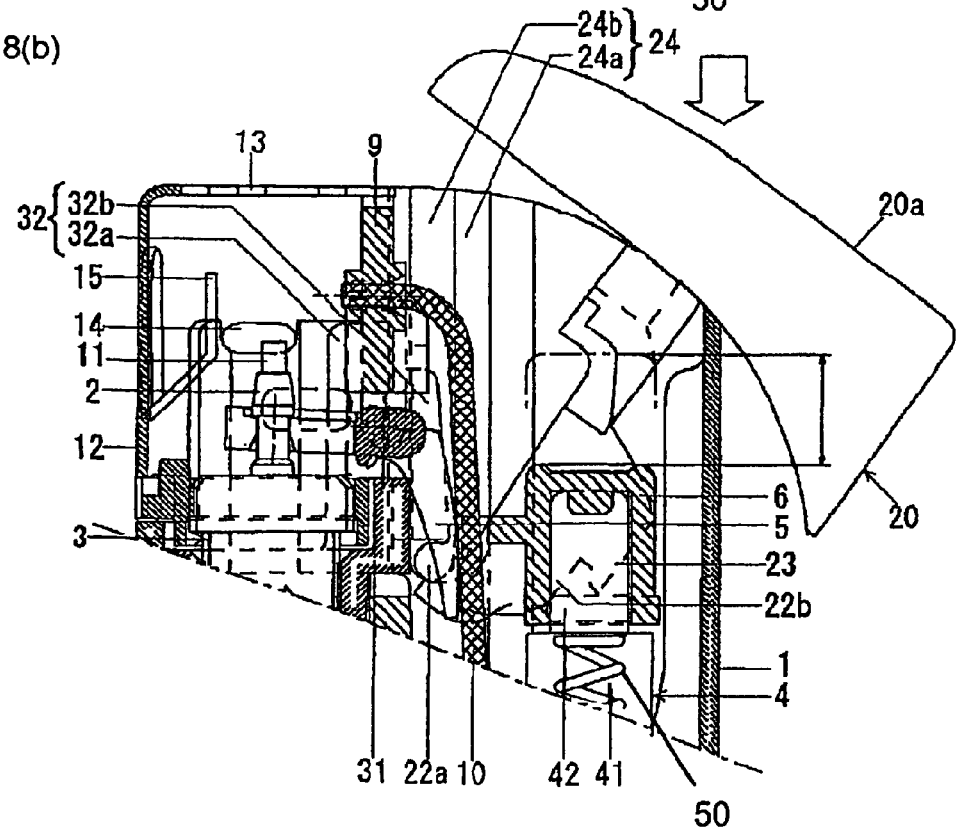

FIGS. 7 and 8 show a third embodiment of the present invention. FIG. 7 is a longitudinal cross section view of the upper portion of the slide type lighter according to the third embodiment. FIG. 8 shows a longitudinal cross section view of the upper portion of the slide type lighter, wherein (a) is in the middle of the ignition operation and (b) is in the ignition operation.

Again, the lighter in the third embodiment has basically the same construction and function as the lighter in the first embodiment. The portions common to those of the first embodiment have the same reference numerals and the following descriptions are focused mostly on the special matters to this embodiment.

In this embodiment, the lighter is assembled by fitting the post portions 32*b*, 32*b* of the upper lid 31 into the engaging portions 24*b*, 24*b* of the grooves 24, 24 in the lighter main body 1. The support portions of the operating cap 20 are designed to have essentially no clearance in the vertical direction when the pivot portions 22*a*, 22*a* of the operating cap 20 are fitted.

The pushing levers (pushing portions) 23, 23 of the operating cap (operation member) 20 strike and pushing the flange portion (the portion to be pushed) 6*a* of the lever pusher 6 are designed such that the curved surface portion of the pushing levers 23, 23 move on and keep pushing the upper surface of the flange portion 6*a* before the ignition operation as shown in FIG. 8(*b*). However, since the slide side of the pushing levers 23, 23 is cut away, at the final stage of the slide operation, the portion that does not have the curved surface of the pushing lever 23, 23 strikes the upper surface of the flange portion 6*a* in an edge shape, thereby preventing further pushing down the flange portion 6*a* and restricting the movement of the piezoelectric mechanism 4 not to lead to the spark ignition by the piezoelectric mechanism 4 as shown in FIG. 8(*a*).

In this case, the complete operation stroke of the piezoelectric mechanism 4 is not achieved only by the slide operation of the operating cap 20. However, downward pushing of the operating cap 20 subsequent to the slide operation the operating cap 20 made from a plastic material is deformed, thereby the pushing levers 23, 23 and the projection portions 22*b*, 22*b* force the lever pusher 6 to push down the lever pusher 6 and generating the discharge voltage by the piezoelectric mechanism 4 as shown in FIG. 8(*b*).

(Fourth Embodiment)

Figure 9:
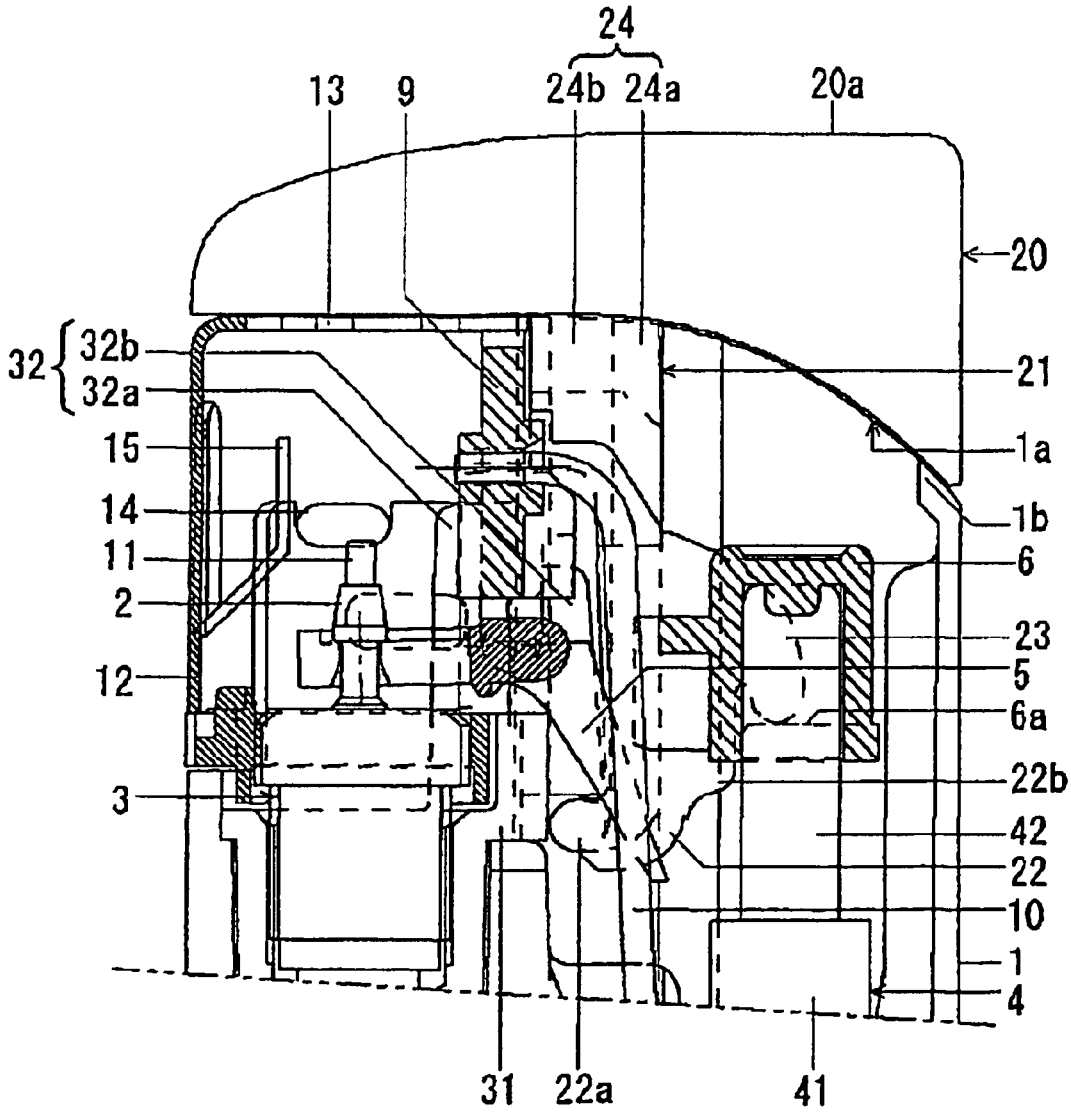
FIG. 9 is a longitudinal cross section view of the upper portion of the slide type lighter according to a fourth embodiment of the present invention.

FIG. 9 is a longitudinal cross section view of the upper portion of the slide type lighter according to a fourth embodiment of the present invention.

Again, the lighter of the fourth embodiment has basically the same construction and function as the lighter of the first embodiment. Accordingly, portions common to those of the first embodiment have the same reference numerals and the following descriptions are focused mostly on special matters to this embodiment.

In this embodiment, the lighter is assembled by fitting the post portions 32*b*, 32*b* of the upper lid 31 into the engaging portions 24*b*, 24*b* of the grooves 24, 24 in the lighter main body 1. The support portions of the operating cap 20 are designed such that no clearance is formed in the vertical direction when the pivot portions 22*a*, 22*a* of the operating cap 20 are fitted in position.

Additionally, a thicker portion 1*b* is formed at the upper end portion and the slide side of the curved surface portion 1*a* of the lighter main body 1 to restrict the slide operation of the operating cap 20 not to reach the position leading to the spark ignition of the piezoelectric mechanism 4 at the final stage of the slide operation of the operating cap (operation member) 20.

In this case, the thicker portion 1*b* restricts the operation stroke not to completely push the piezoelectric mechanism 4 only by the slide operation of the operating cap 20. However, downward pushing operation of the operating cap 20 subsequent to the slide operation 20 forces the operating cap 20 made of plastic material to deform, thereby forcing the pushing levers 23, 23 and the projection portions 22*b*, 22*b* to push down the lever pusher 6 and leading to generating high voltage by the piezoelectric mechanism 4.

(Fifth Embodiment)

Figure 10:
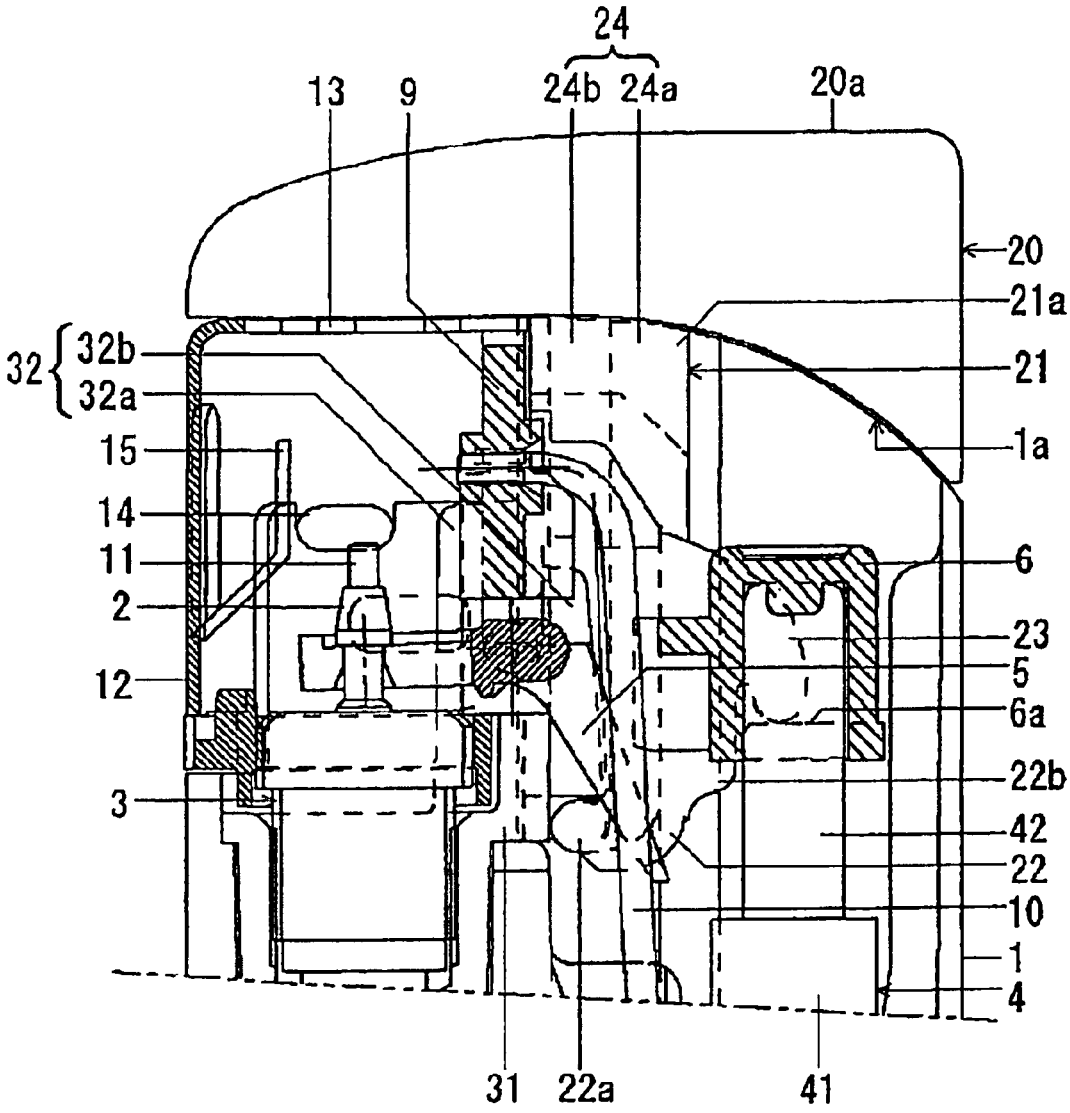
FIG. 10 is a longitudinal cross section view of the upper portion according to a fifth embodiment of the present invention.

FIG. 10 is a longitudinal cross section view of the upper portion of the slide type lighter according to a fifth embodiment of the present invention.

Again, the lighter of the fifth embodiment has basically the same construction and function as the lighter of the first embodiment. Accordingly, the portions common to those of the first embodiment have the same reference numerals and the following descriptions are focused mostly on special matters to this embodiment.

In this embodiment, the lighter is assembled by fitting the post portions 32*b*, 32*b* of the upper lid 31 into the engaging portions 24*b*, 24*b* of the grooves 24, 24 in the lighter main body 1. The support portions of the operating cap 20 are designed such that essentially no clearance is formed in the vertical direction when the pivot portions 22*a*, 22*a* of the operating cap 20 are fitted in position.

And the main body portion of the lever member (rotary lever portion) 21 of the operating cap (operation member) 20 is made thicker at the slide side to restrict the movement in the slide direction by striking the upper edge of the lighter main body at the final stage of the slide operation of the operating cap 20, thereby not leading to the spark ignition by the piezoelectric mechanism 4. In FIG. 10, represented by the reference numeral 21*a* is the thicker portion.

In this case, since the thicker portion 21*a* of the lever member 21 strikes the upper edge of the lighter main body 1, only the slide operation of the operating cap 20 cannot complete the full operation stroke of the piezoelectric mechanism 4. However, downward pushing operation of the operating cap 20 subsequent to the slide operation causes the operating cap 20 made from plastic material to deform, thereby forcing the lever pusher 6 to be pushed down by the pushing levers 23, 23 and the projection portions 22*b*, 22*b* sufficient to generate the high voltage by the piezoelectric mechanism 4.

Additionally, as modified embodiment of the present invention, it is possible, for example, one fulcrum lever is provided at one side of the operation member for supporting the operation member with only one fulcrum portion. The operation member is raised by a spring force and the piezoelectric mechanism 4 is not fully pushed unless the operation member is pushed down subsequent to the slide operation.

Furthermore, although the operating cap 20 is supported by pushing the pivot portions of the operating cap 20 into the grooves in the inner surface of the lighter main body 1 in each of the above embodiments. The present invention can also be applied to a supporting construction to use a pin piercing into the lighter main body 1 as a fulcrum of rotary operation.

It is to be noted that various modifications can be made on the present invention without departing from the scope of this invention.

INDUSTRIAL USABILITY

As understood from the above descriptions on the embodiments, the present invention makes it possible to complete the full operation stroke of the piezoelectric mechanism to enable the spark ignition only after downward pushing operation of the operation member subsequent to the slide operation, thereby effectively preventing ignition by careless operation, misuse, etc.

Furthermore, the 2-step ignition operation can be carried out in a course of a continuous operation of the operation member, thereby minimizing the load to the operating fingers or the like and maintaining good operability.

Additionally, the 2-step operation gives a certain time between the gas emission and the ignition as compared to the conventional spark ignition by the slide operation, thereby enabling to fully mix the fuel gas with air inside the cap in the time period and enhancing the ignition reliability.

What is claimed is:

1. An ignition operation mechanism for slide type lighter comprising an operation member for performing a slide operation along a curved surface portion at one edge of the upper portion of a lighter main body by rotating about a pivot at substantially the center of the curved surface portion for pushing down a piezoelectric mechanism, characterized in that:

the operation member is pushed down subsequent to the slide operation to move the pivot portion of the operation member downward so as to spark ignite by the piezoelectric mechanism the pivot portion being part of the operation member.

2. An ignition operation mechanism for slide type lighter according to claim 1 wherein the operation member contacts the lighter main body at a contact point ending the slide operation, the downward movement of the pivot portion is effected by a force excreted on the operation member away from the contact point, the contact point acting as a fulcrum of a lever member.

3. An ignition operation mechanism for slide type lighter according to claim 2 wherein subsequent to the sliding action, the piezoelectric mechanism is acted upon by a force from a pressing lever, the pressing lever being part of the lever member and being spaced away from the fulcrum.

4. An ignition operation mechanism for slide type lighter according to claim 1 wherein during the slide operation the pivot point acts as a fulcrum for a lever member, the pivot member being kept from upward movement by an upper lid.

5. An ignition operation mechanism for slide type lighter according to claim 4 further comprising a guide portion and an engaging portion the guide portion being adjacent the engaging portion, the pivot member is positioned under the upper lid by sliding the pivot member along the guide portion past the upper lid and into the engaging portion.

6. An ignition operation mechanism for slide type lighter according to claim 4 wherein the guide portion is two guide portions the engaging portion is two engaging portions and the pivot member is two fulcrum portions, the guide portions are sloped just before the lower end thereof for guiding the fulcrum portions towards the engaging portions.

7. An ignition operation mechanism for slide type lighter comprising an operation member for performing a slide operation along a curved surface portion at one edge of the upper portion of a lighter main body by rotating about a pivot at substantially the center of the curved surface portion for pushing down a piezoelectric mechanism, characterized in that:

a support portion as a pivot of rotation of the operation member is shaped and sized to have a predetermined clearance to move up and down the pivot portion within the support member at the lighter main body side for rotatably supporting the fulcrum member; and the pivot portion of the operation member is normally spring biased to the upper position inside the support member but can be moved down inside the support member by the downward pushing of the operation member subsequent to the slide operation for enabling spark ignition by the piezoelectric mechanism the pivot portion being part of the operation member.

8. A method of assembling a slide type lighter comprising the steps of:

fitting an upper lip into a lighter main body, the upper lip extending into a groove shaped engaging portion, the engaging portion being parallel to and adjacent to a groove shaped guide portion, the engaging portion being deeper than the guide portion;

fitting pivot portions being at an end of fulcrum levers, into the guide portion deforming the fulcrum levers, the pivot portions and the fulcrum levers being made as part of a lever member;

sliding the pivot portions along the guide portions until the pivot portions are past the upper lip against a return spring biasing element, a lower end of the guide portion being shaped to guide the pivot portions into the deeper adjacent engaging portion enabling the fulcrum levers to deform less and securing the pivot portions in the engaging portion; and biasing the pivot portion against the upper lip within the engaging portion.

9. A method of assembling a slide type lighter according to claim 8 wherein once assembled a user may slide a top of the lever member to one side thereby pushing a pressing lever being an intermediate distance along the lever member against the biasing element, the lever member contacting the lighter main body at a contact point stopping the stroke of the sliding action, the user then subsequent to the sliding action can push the lever member such that the lever pivots at the contact point, the pivot portion moving within the engaging portion away from the upper lip and the pressing lever further pushing, the biasing element.

* * * * *